US012486835B2

(12) United States Patent
Abdo et al.

(10) Patent No.: US 12,486,835 B2
(45) Date of Patent: Dec. 2, 2025

(54) FLUID COMPRESSION APPARATUS AND METHOD

(71) Applicant: L'Air Liquide, Societe Anonyme pour l'Etude et l'Exploitation des Procedes Georges Claude, Paris (FR)

(72) Inventors: Youssef Abdo, Jouy-en-Josas (FR); Gaetan Coleiro, Sassenage (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 19/028,879

(22) Filed: Jan. 17, 2025

(65) Prior Publication Data

US 2025/0237205 A1 Jul. 24, 2025

(30) Foreign Application Priority Data

Jan. 22, 2024 (FR) ..... FR 2400588

(51) Int. Cl.
*F04B 37/08* (2006.01)
*F04B 3/00* (2006.01)
(Continued)

(52) U.S. Cl.
CPC ..... *F04B 37/08* (2013.01); *F04B 3/00* (2013.01); *F04B 7/04* (2013.01); *F04B 15/08* (2013.01);
(Continued)

(58) Field of Classification Search
CPC .... F04B 37/08; F04B 3/00; F04B 7/04; F04B 15/08; F04B 23/02; F04B 53/10; F04B 53/16
See application file for complete search history.

(56) References Cited

U.S. PATENT DOCUMENTS 4,369,633 A * 1/1983 Snyder ..... F04B 25/02 417/349
4,639,197 A * 1/1987 Tornare ..... F17C 5/02 417/259
(Continued)

FOREIGN PATENT DOCUMENTS

EP 2 687 793 1/2014
FR 3 107 572 8/2021
(Continued)

OTHER PUBLICATIONS

French Search Report for FR 2 400 588, mailed May 29, 2024.

*Primary Examiner* — Hoang M Nguyen
(74) *Attorney, Agent, or Firm* — Justin K. Murray

(57) ABSTRACT

The invention relates to a fluid compression apparatus comprising a sealed enclosure intended to contain a bath of cryogenic fluid, a first and a second compression chambers, an intake system for admission into the first chamber, a system for transfer from the first to the second chamber, the apparatus further comprising a communicating discharge orifice for compressed fluid to leave the second chamber, the apparatus further comprising an overflow discharge orifice provided with a valve for discharge from the first compression chamber to the bath so as to let surplus liquid leave during compression of fluid in the first chamber, the overflow discharge orifice communicating with the enclosure via at least one flow retarder configured to attenuate the speed and/or intensity of the discharged liquid flow by limiting its pressure drop.

16 Claims, 3 Drawing Sheets

(51) Int. Cl.

| | |
|---|---|
| ***F04B 7/04*** | (2006.01) |
| ***F04B 15/08*** | (2006.01) |
| ***F04B 23/02*** | (2006.01) |
| ***F04B 53/10*** | (2006.01) |
| ***F04B 53/16*** | (2006.01) |

(52) U.S. Cl.
CPC ..... *F04B 23/02* (2013.01); *F04B 53/10* (2013.01); *F04B 53/16* (2013.01)

(56) References Cited

U.S. PATENT DOCUMENTS

| | | | | |
|---|---|---|---|---|
| 12,092,098 | B2 | 9/2024 | Benistand-Hector et al. | |
| 12,188,461 | B2 | 1/2025 | Benistand-Hector et al. | |
| 2018/0266405 | A1* | 9/2018 | Foege | F04B 39/06 |
| 2021/0332950 | A1* | 10/2021 | Petitpas | F04B 53/145 |
| 2022/0074397 | A1* | 3/2022 | Crispel | F04B 23/04 |

FOREIGN PATENT DOCUMENTS

| | | |
|---|---|---|
| FR | 3 107 573 | 8/2021 |
| FR | 3 115 569 | 4/2022 |
| GB | 2 080 117 | 2/1982 |
| JP | 2012 163 105 | 8/2012 |

* cited by examiner

[Fig. 1]
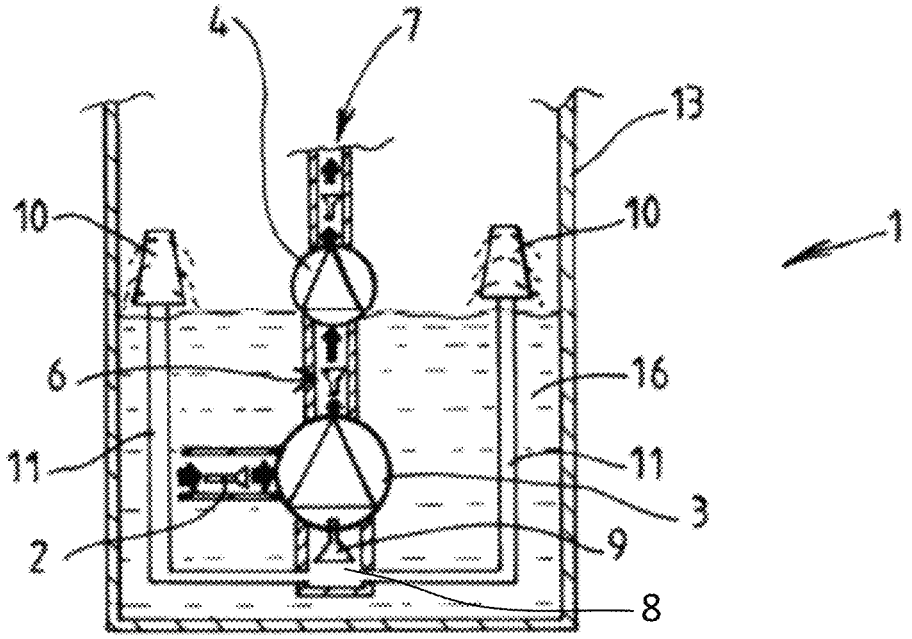
[Fig. 2]
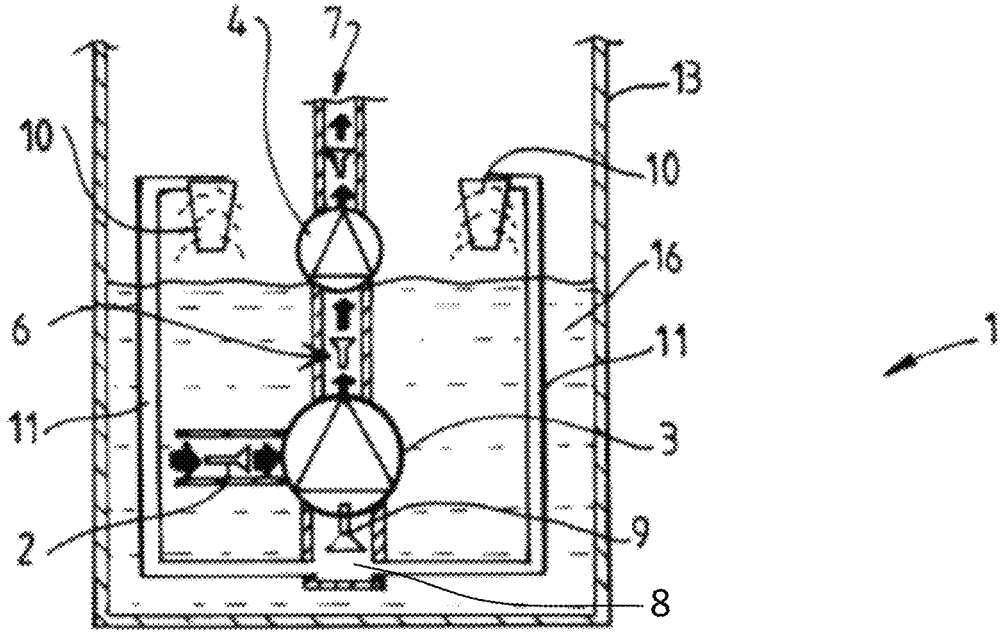

[Fig. 3]
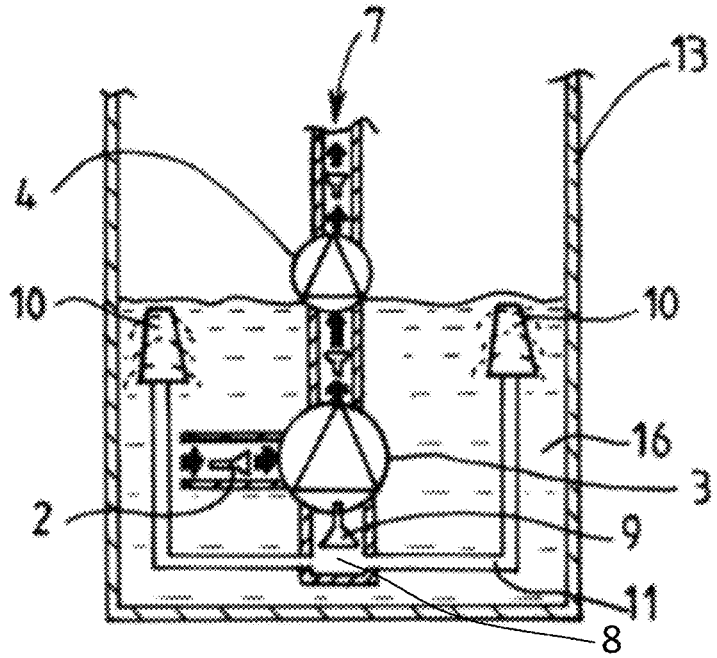
[Fig. 4]
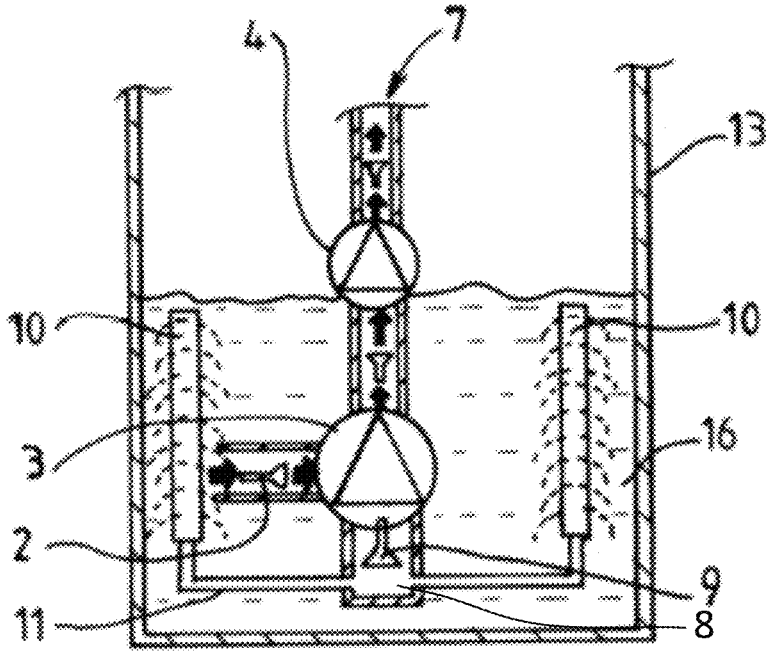

[Fig. 5]
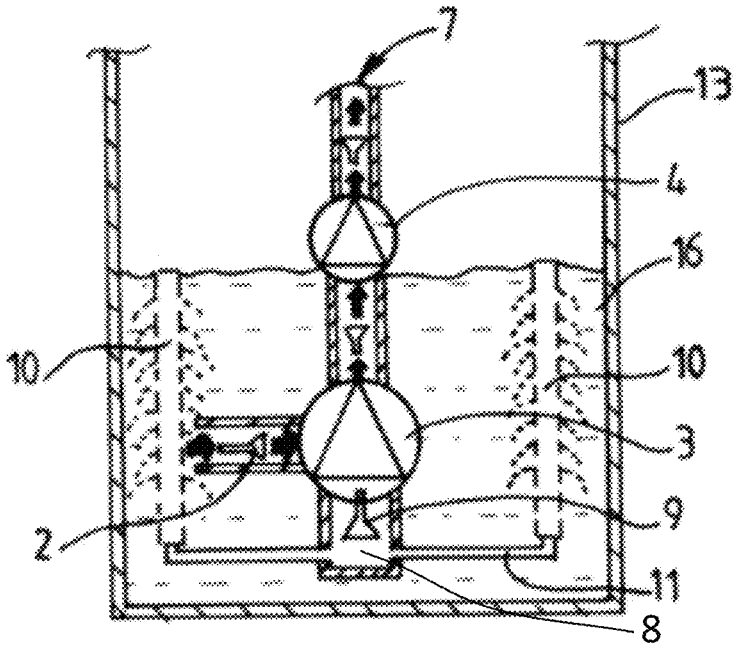
[Fig. 6]
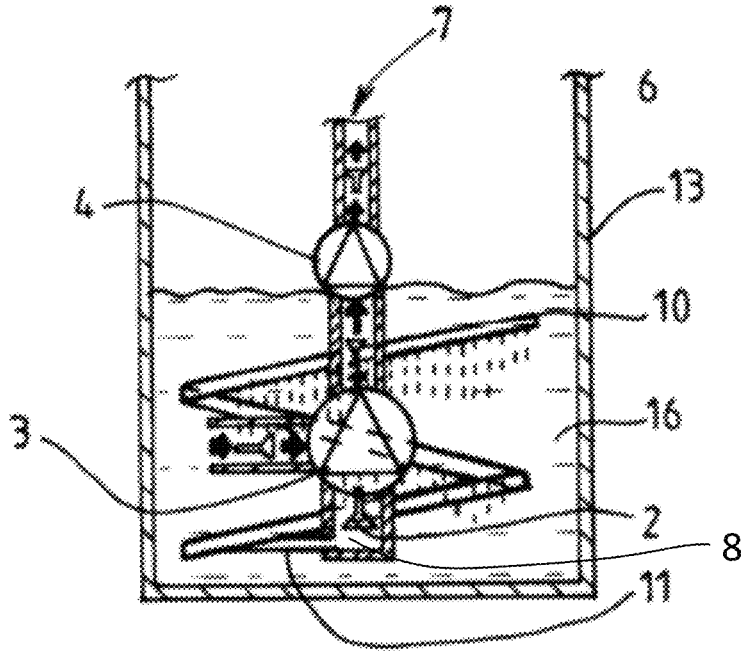

FLUID COMPRESSION APPARATUS AND METHOD

CROSS REFERENCE TO RELATED APPLICATIONS

This application claims the benefit of priority under 35 U.S.C. § 119 (a) and (b) to French patent application No. FR2400588, filed Jan. 22, 2024, which is herein incorporated by reference in its entirety.

FIELD OF THE INVENTION

The invention relates to a fluid compression apparatus and method.

BACKGROUND OF THE INVENTION

To increase the performance and volumetric efficiency of liquid hydrogen pumps, it is essential to have a good thermodynamic quality of the liquid at the intake. This is to avoid cavitation by pressure drop and thermal input. The high-pressure compression of the liquid drawn from a tank containing the pump (bath or sump) is often preceded by a first compression stage (or pre-compression). This pre-compression is generally a compression stage with a lower rate than the second compression stage. This first compression stage draws in quasi-saturated liquid at the saturation temperature of the bath and mechanically subcools it by pressurization in order to achieve good filling without "flash" vaporization at the compression stage.

In the case, in particular, in which the two compression stages are realized by opposite movements of one and the same piston, the phase of filling the second compression stage therefore takes place at the same time as the compression in the first stage.

Since the diameters of the chambers are different but the piston stroke is identical, the swept volumes can therefore be different (typically the volume of the first stage is larger than that of the second stage). Assuming that the density of the fluid remains relatively constant (because there is little compressibility in the absence of flash vaporization) during the admission into the second stage, it may be essential to discharge some of the pressurized liquid from the first compression chamber.

It is known to provide ports or channels establishing communication between the first compression chamber and the bath so as to naturally discharge this surplus fluid to the bath.

This discharge of excess liquid from the first compression stage can generate vaporization gas in the bath.

An aim of the present invention is to overcome all or some of the drawbacks of the prior art that are set out above.

SUMMARY OF THE INVENTION

In certain embodiments, the invention relates more particularly to a fluid compression apparatus with a plurality of compression stages, comprising a sealed enclosure intended to contain a bath of cryogenic fluid having a liquid phase, the upper part of the enclosure being intended to contain a gas headspace, a first compression chamber, a second compression chamber, an intake system that communicates with the first compression chamber and is configured to allow fluid to enter said first compression chamber, a transfer system that communicates with the first and the second compression chamber and is configured to allow the transfer of fluid pre-compressed in the first compression chamber to the second compression chamber, the apparatus also comprising a discharge orifice that communicates with the second compression chamber and is configured to allow fluid compressed in the second compression chamber to leave, wherein the intake system comprises one or more valves configured to ensure fluid to be compressed enters the first compression chamber during an intake phase and to prevent fluid from leaving in the compression phase, the apparatus further comprising a discharge orifice allowing communication between the first compression chamber and the bath so as to let surplus liquid trapped in the first compression chamber leave during compression of fluid in the first compression chamber.

In an effort to overcome the deficiencies of the prior art discussed, supra, the apparatus according to the invention, which is otherwise in accordance with the generic definition thereof given in the above preamble, is configured such that it has a discharge valve configured to control the discharge of liquid via the discharge orifice and to prevent fluid from entering the first compression chamber via the discharge orifice, the discharge orifice communicating with the enclosure via at least one flow retarder configured to attenuate the speed and/or intensity of the discharged liquid flow by limiting its pressure drop.

Furthermore, embodiments of the invention may have one or more of the following features:

- the flow retarder comprises at least one of: a set of diffusion holes, a nozzle made of porous material of which the permeability is preferably greater than five darcy,
- the flow retarder comprises at least one of: a nozzle made of porous sintered material, for example bronze or stainless steel, preferably of cylindrical or conical shape,
- the retarder has a length of between 15 mm and 450 mm and a diameter preferably of between 10 mm and 80 mm,
- the discharge orifice communicates with the enclosure via at least one discharge duct opening into the enclosure in the bath so as to be situated in and/or above the liquid level of the bath of the enclosure,
- the discharge duct has a portion extending into the enclosure parallel to the vertical direction and/or transverse to the vertical direction,
- the discharge duct extends from the bottom towards the top of the enclosure,
- the discharge orifice communicates with the enclosure via a plurality of discharge ducts opening into the enclosure,
- the apparatus comprises a piston that is able to move so as to compress the fluid in the first and second compression chambers during alternating opposite movements,
- the container contains a bath constituted of cryogenic liquid, for example liquefied hydrogen.

The invention also relates to a method for pumping cryogenic fluid using such an apparatus, wherein the container contains a bath of liquefied cryogenic fluid, the method comprising a step of admitting liquid into the first compression chamber via the intake system and a step of compressing fluid in the second compression chamber, and then a step of admitting fluid into the second compression chamber via the transfer system and a step of compressing the fluid in the first compression chamber during which surplus fluid is discharged from the first compression chamber to the bath via the discharge orifice and the at least one retarder.

The invention may also relate to any alternative device or method comprising any combination of the features above or below within the scope of the claims.

BRIEF DESCRIPTION OF THE DRAWINGS

The invention will be understood better from reading the following description and from studying the accompanying figures. These figures are given only by way of illustration and do not in any way limit the invention.

FIG. 1 is a schematic and partial view in vertical cross section, illustrating a first exemplary embodiment of an apparatus according to the invention.

FIG. 2 is a schematic and partial view in vertical cross section, illustrating a second exemplary embodiment of an apparatus according to the invention.

FIG. 3 is a schematic and partial view in vertical cross section, illustrating a third exemplary embodiment of an apparatus according to the invention.

FIG. 4 is a schematic and partial view in vertical cross section, illustrating a fourth exemplary embodiment of an apparatus according to the invention.

FIG. 5 is a schematic and partial view in vertical cross section, illustrating a fifth exemplary embodiment of an apparatus according to the invention.

FIG. 6 is a schematic and partial view in vertical cross section, illustrating a sixth exemplary embodiment of an apparatus according to the invention.

DETAILED DESCRIPTION OF THE INVENTION

Throughout the figures, the same references relate to the same elements.

In this detailed description, the following embodiments are examples. Although the description refers to one or more embodiments, this does not mean that the features apply only to a single embodiment. Individual features of different embodiments may also be combined and/or interchanged in order to provide other embodiments.

The fluid compression apparatus 1 depicted in FIG. 1 comprises two compression stages in series.

The apparatus 1 comprises in particular a first compression chamber 3 (compression at relatively low pressure) and a second compression chamber 4 (at relatively high pressure).

The apparatus 1 comprises an intake system 2 communicating with the first compression chamber 3, which is configured to allow fluid (liquid) that is to be compressed to enter said first compression chamber 3.

The intake system 2 comprises for example at least one of: one or more non-return valves, one or more orifices or ports, at least one flat-disc valve or any other device or valve that allows fluid that is to be compressed to enter the first compression chamber 3 during an intake phase and prevents fluid from leaving in the compression phase.

In particular, this intake system 2 (valve(s) and/or the like) may be configured to open in the event of a given pressure differential between its two ends. In addition, the first chamber 3 may possibly be equipped with a relief valve or other safety element configured to limit the pressure within the chamber to below a given safety threshold.

As illustrated, the second compression stage (with the second compression chamber 4) is not necessarily submerged in the liquid bath 16; it may be partially or totally above the bath 16. Preferably, the first compression stage (with the first compression chamber 3) is not necessarily submerged in the liquid bath 16; at least the intake system is submerged or connected to the liquid bath.

The apparatus 1 also comprises a non-return transfer system 6 that communicates with the first 3 and the second 4 compression chamber and is configured to allow the transfer of fluid compressed in the first compression chamber 3 to the second compression chamber 4 (during and/or at the end of the phase of compression of the fluid in the first compression chamber 3) but which remains closed during the phase of compression in the second compression chamber 4. This transfer system 6 may be of the same type as that of the intake system 2.

The apparatus 1 may comprise a piston that is able to move in translation (actuated by a drive member) with an alternating movement so as to compress the fluid in the first 3 and second 4 compression chambers. For example, the compression movement in one chamber simultaneously ensures the admission into the other chamber (and vice versa).

The apparatus 1 also comprises a communicating discharge orifice 7 that communicates with the second compression chamber 4 and is configured to allow high-pressure compressed fluid to leave the second compression chamber 4 (during or at the end of the phase of compression in this chamber 4). The communicating discharge orifice 7 may be provided with a non-return system, which may be of the same type as that of the intake system 2 (for example closed as long as the pressure differential between the second compression chamber 4 and the outside is below a given threshold).

The apparatus 1 may comprise a compressed gas discharge duct comprising a first, lower end connected to this communicating discharge orifice 7 and a second, upper end situated in the upper part of the apparatus 1 for collecting the compressed high-pressure fluid.

As a preference, the first compression chamber 3 is configured to encourage the gas to escape via the ports or valves.

For example, one or more ports and/or orifices (not shown) may be formed in any portion of wall delimiting at least a part of the first compression chamber 3. These ports can be provided so that, in the intake phase (as the chamber 3 is enlarging), any gas that might be present in the first compression chamber 3 can escape via these ports and give up its place to liquid from the surrounding bath. This ensures complete filling with liquid during admission. In addition, in the compression phase, these ports may allow the surplus liquid to escape, thereby metering the volume of liquid that will be trapped therein (this volume can be determined by the position of the ports 26).

As illustrated, the compression apparatus 1 may comprise a thermally insulated sealed enclosure 13 containing a bath 16 of cryogenic cooling fluid. In particular, the first compression chamber 3 and optionally the second compression chamber 4 may be submerged in a liquid phase. The upper part of the enclosure 16 may have a gas headspace that collects any leaks in the apparatus 1.

The compression apparatus 1 further comprises an overflow discharge orifice 8 that allows fluidic communication between the first compression chamber 3 and the bath 16 and is configured to let surplus liquid trapped in the first compression chamber 3 leave during compression in the first compression chamber 3.

A discharge valve 9 is preferably provided to control the discharge of liquid via the overflow discharge orifice & and to prevent fluid from entering the compression chamber 3 via the overflow discharge orifice 8.

As illustrated, the overflow discharge orifice & communicates with the enclosure 13 via at least one flow retarder 10 configured to attenuate the speed and/or intensity of the discharged liquid flow by breaking the jet and using a relatively large discharge surface.

The retarder 10 is preferably configured to reduce the effect of pressure drops generated by diffusion or friction or violent shocks due to vigorous discharged jets. The retarder "breaks" such jets.

Such a retarder 10 produces non-sudden discharge of the flow, which loses speed but which converts the speed into pressure rather than into pressure drop.

This limits friction or possible spattering of liquid towards hot areas of the wall of the suction bath that can cause evaporation thereof.

The flow retarder 10 may comprise, for example, a nozzle of porous material, cf. FIG. 1, FIG. 2, FIG. 3 and FIG. 4. For example, porous sintered materials may comprise: a sinter made of bronze or stainless steel, for example of cylindrical or conical shape. The length can be between 15 mm and 450 mm. The diameter can be between 10 mm and 80 mm. The permeability may be greater than five darcy (>5 D), one darcy being equal to $10^{-12}$ $m^2$.

This makes it possible to "break" the discharged jet without pressure drop while at the same time reducing the contact of the liquid close to saturation with potentially warmer parts or steam of the bath 16.

As illustrated, the overflow discharge orifice 8 can communicate with the enclosure 13 via at least one discharge duct 11 (two in the illustrated examples) opening into the enclosure 13. Each duct 11 may be provided with a retarder 10.

The one or more discharge ducts 11 may extend:

- horizontally and open, for example, into the lower part of the container 13, in the liquid bath,
- horizontally and then vertically upwards and open, for example, into the lower part of the container, in the liquid bath, cf. FIG. 3,
- horizontally and then vertically and open, for example, at the junction between the liquid bath and the gas headspace,
- horizontally and then vertically and open, for example, above the liquid bath and the gas headspace, cf. FIG. 1 and FIG. 2.

The retarder 10 is preferably provided at the downstream end of the discharge duct 11 (in the container/bath).

Thus, as illustrated, the ends of the discharge ducts 10 can be oriented upwards or downwards or horizontally.

In particular, it is possible to orient the one or more discharge ducts 10 vertically in order to reduce contact between the potential bubbles and the liquid of the bath 16. In this way, the bubbles are directed rather towards the top of the bath and therefore towards the gas headspace while the liquid is poured into the liquid phase.

In the event of discharge into the gas part, the discharged liquid flow can run off and be poured slowly into the liquid phase. In this way the heat exchange between the liquid phase and the gas phase is limited. As illustrated, the two discharge ducts 11 can be connected to one and the same discharge valve 9 via a common chamber.

In the variant in FIG. 4, the retarder 10 comprises or is constituted of a tube with a porous surface that extends vertically in the container 13.

In the variant in FIG. 5, the retarder 10 comprises or is constituted of a tube pierced with a multitude of orifices so as to allow the liquid to run off. For example, the orifices have dimensions of between 0.05 mm and 1 mm.

In the variant in FIG. 6, the retarder 10 comprises or is constituted of a tube pierced with a multitude of orifices arranged in a serpentine around at least one of the two compression chambers.

The invention is particularly advantageous for pumping hydrogen, for example so as to produce a flow of hydrogen at very high pressure at the outlet of the second compression stage (pressure between 100 and 1000 bar for example).

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

The invention claimed is:

1. A fluid compression apparatus with a plurality of compression stages, the fluid compression apparatus comprising:

- a sealed enclosure configured to contain a bath of cryogenic fluid having a liquid phase, the upper part of the sealed enclosure configured to contain a gas headspace;
- a first compression chamber;
- a second compression chamber;
- an intake system that communicates with the first compression chamber and is configured to allow fluid to enter said first compression chamber;
- a transfer system that communicates with the first and the second compression chambers and is configured to allow the transfer of fluid pre-compressed in the first compression chamber to the second compression chamber;

a communicating discharge orifice that communicates with the second compression chamber and is configured to allow fluid compressed in the second compression chamber to leave, wherein the intake system comprises one or more valves configured to ensure fluid to be compressed enters the first compression chamber during an intake phase and to prevent fluid from leaving in the compression phase;

an overflow discharge orifice allowing communication between the first compression chamber and the bath so as to let surplus liquid trapped in the first compression chamber leave during compression of fluid in the first compression chamber;

a discharge valve configured to control the discharge of liquid via the overflow discharge orifice and to prevent fluid from entering the first compression chamber via the overflow discharge orifice;

wherein the overflow discharge orifice communicates with the sealed enclosure via at least one flow retarder configured to attenuate the speed and/or intensity of the discharged liquid flow by limiting a pressure drop of the discharged liquid.

2. The apparatus as claimed in claim 1, wherein the flow retarder comprises at least one of: a set of diffusion holes, a nozzle made of porous material.

3. The apparatus as claimed in claim 2, wherein the porous material of the nozzle has a permeability greater than five darcy.

4. The apparatus as claimed in claim 1, wherein the flow retarder comprises at least one of: a nozzle made of porous sintered material.

5. The apparatus as claimed in claim 4, wherein the porous sintered material is bronze or stainless steel.

6. The apparatus as claimed in claim 4, wherein the porous sintered material has a cylindrical or conical shape.

7. The apparatus as claimed in claim 1, wherein the retarder has a length of between 15 mm and 450 mm.

8. The apparatus as claimed in claim 1, wherein the retarder has a diameter of between 10 mm and 80 mm.

9. The apparatus as claimed in claim 1, wherein the overflow discharge orifice communicates with the enclosure via at least one discharge duct opening into the enclosure in the bath so as to be situated in and/or above the liquid level of the bath of the enclosure.

10. The apparatus as claimed in claim 9, wherein the discharge duct has a portion extending into the enclosure parallel to the vertical direction and/or transverse to the vertical direction.

11. The apparatus as claimed in claim 9, wherein the discharge duct extends from the bottom towards the top of the enclosure.

12. The apparatus as claimed in claim 9, wherein the overflow discharge orifice communicates with the enclosure via a plurality of discharge ducts opening into the enclosure.

13. The apparatus as claimed in claim 1, further comprising a piston that is configured to move so as to compress the fluid in the first and second compression chambers during alternating opposite movements.

14. The apparatus as claimed in claim 1, wherein the container contains a bath constituted of cryogenic liquid.

15. The apparatus as claimed in claim 14, wherein the cryogenic liquid is liquefied hydrogen.

16. A method for pumping cryogenic fluid, the method comprising the steps of:

providing the apparatus as claimed in claim 1, wherein the container contains a bath of liquefied cryogenic fluid, admitting liquid into the first compression chamber via the intake system and compressing fluid in the second compression chamber; and then admitting fluid into the second compression chamber via the transfer system and compressing the fluid in the first compression chamber during which surplus fluid is discharged from the first compression chamber to the bath via the overflow discharge orifice and the at least one retarder.

* * * * *